United States Patent [19]

Gerlach et al.

[11] Patent Number: 4,868,440

[45] Date of Patent: Sep. 19, 1989

[54] COMMUTATOR FOR SMALL TO MEDIUM-SIZED MACHINES

[75] Inventors: Karl-Heinz Gerlach, Ehningen; Lothar Woerner; Dietrich Ersing, both of Stuttgart, all of Fed. Rep. of Germany

[73] Assignee: Kautt & Bux KG, Fed. Rep. of Germany

[21] Appl. No.: 186,640

[22] Filed: Apr. 27, 1988

[30] Foreign Application Priority Data

Apr. 28, 1987 [DE] Fed. Rep. of Germany ..... 3714098

[51] Int. Cl.[4] ..... H01R 39/16; H01R 43/06

[52] U.S. Cl. ..... 310/236; 29/597; 310/43

[58] Field of Search ..... 29/597; 310/42, 43, 310/233, 235, 236, 234, 237

[56] References Cited

U.S. PATENT DOCUMENTS

| | | | |
|---|---|---|---|
| 3,450,914 | 6/1969 | Demerciere | 310/236 |
| 3,549,927 | 12/1970 | Mann | 310/236 |
| 3,908,265 | 9/1975 | Heil et al. | 310/235 |
| 4,562,369 | 12/1985 | Gerlach et al. | 310/235 |
| 4,598,463 | 7/1986 | Gerlach et al. | 310/43 |

FOREIGN PATENT DOCUMENTS

| | | | |
|---|---|---|---|
| 130679 | 8/1947 | Australia | 310/235 |
| 856654 | 11/1952 | Fed. Rep. of Germany . | |

*Primary Examiner*—Patrick R. Salce
*Assistant Examiner*—D. L. Rebsch
*Attorney, Agent, or Firm*—Wigman & Cohen

[57] ABSTRACT

In a small to medium-sized commutator having segments which are circumferentially spaced from each other and are insulated from a hub, with at least one concentric annular groove in the body formed by the segments, in which groove a biased reinforcing ring is arranged. The body formed by the segments is free of arch compression at least in its dynamically and thermally unloaded condition. The segments, under a compression loading of the insulated or insulating hub and/or shaft, are acted upon radially with a compression force corresponding to the total biasing of all present reinforcing rings.

In the manufacture of the commutator, each reinforcing ring is in its expanded condition when it is brought into the position provided in the annular groove. Thereafter, spacing elements used to position the segments are removed from the intermediate spaces between the segments.

13 Claims, 2 Drawing Sheets

COMMUTATOR FOR SMALL TO MEDIUM-SIZED MACHINES

BACKGROUND OF THE INVENTION

1. Field of the Invention

The invention relates to a commutator for small to medium-sized machines in which a number of circumferentially spaced segments having boundry surfaces defining an inner cover surface facing the longitudinal axis of the commutator directly abut an insulated rigid hub, and more particularly to such a commutator in which the segments form a body having at least one annular ring in which a biasing ring is arranged, and to a method for its manufacture.

2. Description of the Prior Art

The known commutators of this type are compression molded commutators in which the segment series is held together not only by the insulating molded material in which the segments are anchored, but also by reinforcing rings provided in annular grooves in the segment series to increase the dynamic load-bearing capacity of the commutator.

If the reinforcing rings are placed in the annular grooves with no bias, the increase in dynamic load-bearing capacity of the commutator is relatively small, because the reinforcing rings only assume the portion of the load by which the molded body is relieved by centrifugal force when the segment series begins to spread due to the centrifugal force.

But even if the reinforcing rings are placed into the annular grooves of a molded commutator with bias, no material increase in the dynamic load-bearing capacity of the commutator is achieved. This is due in part to the fact that the molded material shrinks more rapidly during cooling than the segment series, thus further reducing the ring bias tension as the spacing strips are removed which position the segments until the compression molding material is fully in place. Another significant reason is to be seen in the fact that the compression molding material, which is usually composed of resin and fillers, at least partially separates during the filling process, i.e., during the filling in of the segment series, whereby the already present nonhomogeneity of the components of the compression molding material employed is further increased, which leads to a distortion of the originally round outer surface during dynamic and thermal loading as a result of unequal tangential and radial bias.

Therefore, in those cases in which high dynamic and thermal loads occur, commutators of the compression arch construction are employed. In these commutators the segments are spaced by insulating laminae, which themselves undergo a plastic deformation during the molding of the segment series. The prebiased reinforcing rings product the requisite arch pressure and also effect the necessary forced closure with the hub or shaft. Until recently, it has been attempted to utilize the tension force of the reinforcing rings as much as possible for the production of the arch pressure, in order to obtain the highest possible arch pressure. The most recent high-performance commutators of the compression arch type construction, in contrast, use a significant proportion of the bias of the reinforcing rings to produce a radial prebiasing of the hub or shaft by means of a corresponding radial compression of the segments against the hub or shaft. However, just as before, even when cold, they exhibit an arch compression.

SUMMARY AND OBJECTS OF THE INVENTION

Since on the one hand commutators of the compression arch construction are expensive and are therefore generally unavailable in small to medium-sized commutator machines for cost reasons, and on the other hand the economical compression molded commutators in many cases do not have adequate dynamic and thermal load-bearing capacity, the primary object of the invention is to create a commutator for small to medium-sized commutator machines which is both economical and also has a significantly greater dynamic and thermal load-bearing capacity than the known compression molded commutators.

Briefly described, the aforementioned object is accomplished according to the invention by providing a small to medium-sized commutator having segments which are circumferentially spaced from each other and are insulated from an insulated hub, the segments forming a body having at least one annular groove lying concentric to the inner cover surface of the segments, in which groove a biased reinforcing ring is arranged. The commutator is characterized in that the body formed by the segments is free of arch compressions at least in its dynamically and thermally unloaded conditions and that the segments, under a compression load from the insulated hub, are acted upon in a radial direction with a compression which corresponds to the entire biasing of all reinforcing rings.

By means of the fact that the combined tension force of all of the reinforcing rings present is applied to the radial compression of the segments against the unyielding hub or shaft while avoiding any arch compression, the segments are positioned by the hub or shaft not only when the commutator is at rest, but also under dynamic and thermal loads. Because the hub or shaft does not lose its cylindrical shape even in operation, it is assured that the brush contact surface of the commutator, even under dynamic and thermal loading, does not lose its cylindrical shape concentric to the rotational axis. It is true that the commutator experiences a certain spreading as a result of the dynamic loading. However, this is very limited and occurs uniformly over the entire circumference of the commutator, which is due to the fact that the extremely hard spring characteristic of the hub and/or shaft and the high potential energy incorporated into it from the entire tension force of all of the reinforcing rings compensate for the centrifugal force acting on the segments during operation by permitting the radial tension on the hub and/or shaft to act over only an extremely short path. Because the distortion of the brush contact surface is primarily due to the fact that a material which is burdened with unavoidable nonhomogeneities is used directly in the mechanical construction of the commutator, which, in conjunction with the initial arch compression and additionally such compression as the commutator gets warmer, leads to unequal deformations of the segment series, in the commutator according to the invention, due to its construction without compression molding material and the resultant freedom arch compression, distortion of its brush contact surface is practically eliminated, especially since the positioning of the segments by the prebiased hub or shaft also works to counter any nonuniform deformation.

The design of the commutator according to the invention results in the additional advantage of a savings of material because of a reduced segment base height (=radial height of the material section between the annular groove containing the reinforcing ring and the boundary surface of the segments defining the inner cover surface), which simultaneously permits the commutators to be provided with a larger inside bore or a smaller outside diameter.

The manufacturing expense is no greater than that of a known commutator made from compression molded material with prebiased reinforcing rings, and the commutator according to the invention therefore also fulfills the requirement of being economical.

It is generally sufficient to provide one reinforcing ring on each frontal side of the commutator. Of course, it is also possible to provide at least one additional reinforcing ring between the frontal side reinforcing rings. The only critical factor is that the pressure load resulting from the tension of all provided reinforcing rings on the hub and/or shaft through the segments that are pressed against it radially is greater than the reduction in this load that occurs during operation, so that the hub and/or shaft is subject to a radial tension even under operating conditions.

In order to joint the segments into a stable unitary structure, it is generally effective to fill the intermediate spaces between the segments and/or the free spaces at the two frontal sides at least partially with an insulating material or an extruded material, particularly the commonly used compression molding material, whereby it is advantageous to be sure that this insulating material ends at the distance from the brush contact surface.

An additional object of the invention is to provide an insulation between the inner cover surface defined by the segments and the hub or shaft which is allowed to change its radial thickness as little as possible as a result of the compression loads to which it is subjected. This object is achieved by providing advantageous embodiments of the invention in which the insulation is formed by a pressure and heat resistant foil which is wrapped circumferentially or in a coil-like manner around the hub and at least forms simple overlaps, the insulation comprises a self-adhesive foil and/or a foil that is bakable in the overlapping areas, or the insulation comprises a thin-walled pressure and heat resistant insulating tube or a tube made from a pressure and heat resistant insulated foil or laminated foil that is shrink-fitted onto the outer cover surface of the hub, which is itself made of metal or insulating material.

A further object of the invention is to create a method for the manufacture of the commutator according to the invention. This object is achieved with a method in which each reinforcing ring is brought into position in the annular groove in an expanded condition and thereafter spacing elements used for positioning the segments are removed from the intermediate spaces between the segments.

If the reinforcing rings are placed in the annular grooves with the final tension or the final tension is imparted to them as they are put in place, the segments are advantageously positioned directly against an insulated or insulating hub or shaft. However, the final biasing of the reinforcing rings can also be obtained in two steps. In this case the segments are first positioned on an element having a smaller diameter than the provided hub or shaft. After the reinforcing rings are put in place, which at this stage of manufacture have not yet been brought to their final bias tension, the hollow body consisting of the segments and the reinforcing rings is radially spread and the hub or shaft is introduced, thus bringing the reinforcing rings to their final tension.

The introduction of the insulating material between the segments and/or into the free spaces at the frontal sides does not take place until after the reinforcing rings have received their final bais tension, so that the introduction of the insulating material, which is preferably a compression molding material, does not result in the formation of arch compression.

With the foregoing and other objects, advantages and features of the invention that will become hereinafter apparent, the nature of the invention may be more clearly understood by reference to the following detailed description of the invention, the appended claims and to the several views illustrated in the attached drawings.

DETAILED DESCRIPTION OF THE PREFERRED EMBODIMENTS

Figure 1:
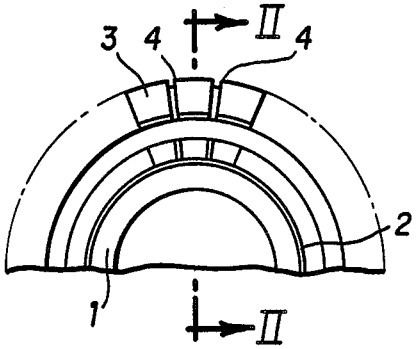
FIG. 1 is a partial front elevation of a first exemplary embodiment.
Figure 2:
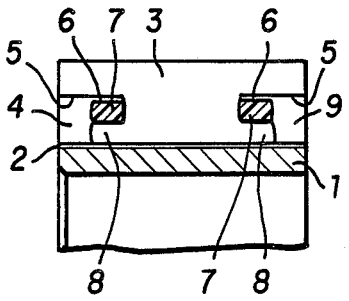
FIG. 2 is a section along the line II—II of FIG. 1.

Referring now in detail to the drawings wherein like parts are designated by like reference numerals throughout, there is illustrated in FIGS. 1 and 2 a commutator for small to medium-sized machines which includes a hub 1, which has an outer cover surface that is concentric with respect to its longitudinal axis. This outer cover surface is coated with an insulating material 2. The thickness thereof is of minimal importance with respect to the requisite electrical voltage stability. In the exemplary embodiment the insulation 2 consists of a pressure and heat resistant insulating foil, which wraps around the hub 1 in a coil-like manner, whereby a multiple overlapping takes place. It would also be possible to wrap in the circumferential direction and to use a self-adhering or bakable insulating foil, or to use a shrinkable insulating tube. All that is important is that, in addition to the requisite electrical voltage stability, it provide the smallest possible thickness and the greatest possible resistance to pressure from radial compression loads.

The boundary surface of the indentically formed segments 3 which defines the inner cover surface of the hollow element formed by the segments, abuts the outer cover surface of the insulation 2. The segments 3 are made from a material commonly used for commutator segments. The segments 3 are circumferentially spaced from each other, whereby all intermediate spaces 4 between adjacent segments 3 are the same size. Due to the common wedge shape of the segments 3, the width of the intermediate spaces 4 measured circumferentially remains constant over their entire radial length.

The end sections of the segments 3 forming the two frontal sides of the commutator are provided with respective stamped openings or annular grooves 5 of identical shape and size. As shown in FIG. 2, the stamped openings 5 form respective annular grooves 6 set back from the frontal side, in which biased reinforcing rings 7 lie. In the exemplary embodiment the two identical reinforcing rings 7 are made from a fiber-reinforced, electrically insulating plastic. However, they could also be made of steel, but then would have to be provided with a pressure and heat resistant insulation. The distance of the base of the annular groove 6 from the adjacent frontal size of the commutator, as shown in FIG. 2, is greater than the depth of the annular groove 5 measured in the axial direction. The depth of the anular groove 5 is adapted to the width of the reinforcing rings 7. The inner surface forming the inside of the annular groove 6, which forms the seat for the reinforcing ring, in contrast, has only a single measurement in the axial direction, which corresponds to the width of the reinforcing ring 7 measured in the same direction.

The material portions 8 lying between this surface and the boundary surface defining the inner cover surface therefore ends at a distance from the adjacent frontal surface of the commutator. A free space 9 is therefore present between this frontal surface on one side and the reinforcing ring 7 and the material portion 8.

The radial height of the material portion 8 is chosen to be so small that the reinforcing ring 7 would tend to bend the material portion 8 inward in consequence of its bias, if the material portion 8 were not supported on the insulation 2 of the hub 1. The diameter of the inner cover surface of the hollow body formed by the segments 3 is therefore relatively large in relation to the diameter of the outer cover surface forming the brush contact surface.

Because only air is contained in the intermediate spaces 4, the commutator is free of arch compressions. The bias of the two reinforcing rings 7, which is completely translated into a radial compression of the segments 3 against the hub 1, thus biasing the hub 1 in the radial direction, is sufficiently strong that even under the greatest expected dynamic load on the commutator and the resultant centrifugal force acting on the segments 3, the hub 1 remains subject to a radial bias.

In the manufacture of the commutator the segments 3 are brought into the position illustrated in FIG. 1, into abutment against the outer cover surface of the insulation 2 of the hub 1. An auxiliary device holds the segments 3 in this position and engages between the segments 3 with spacing strips, so that the intermediate spaces 4 are held at the prescribed distance from each other. After the prebiased reinforcing rings 7 have been placed in the annular grooves 6, the spacing strips are removed.

If it is not possible to place the reinforcing rings 7 into the annular grooves 6 with the requisite bias, the segments 3 are first placed against a cylindrical element, the outside diameter of which is smller than the diameter of the outer cover surface of the insulation 2. After the placement of the biased reinforcing rings 7 the hollow body consisting of the segments 3 and the reinforcing rings 7 is spread apart and pushed, e.g., by means of a conical sleeve set next to the cylindrical element, to the diameter of the hub 1 and its insulation 2 following this sleeve, thereby imparting the desired bias to the reinforcing rings 7.

Figure 3:
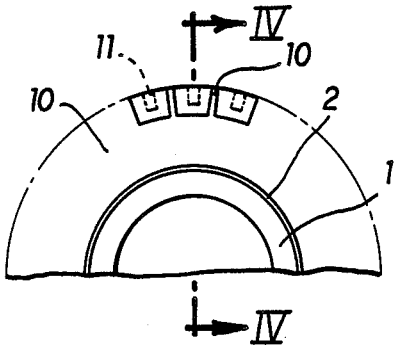
FIG. 3 is a view according to FIG. 1 of a second exemplary embodiment.
Figure 4:
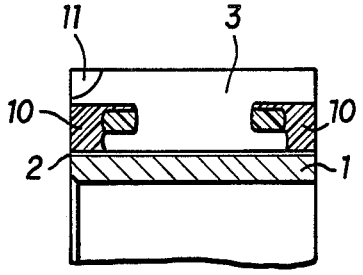
FIG. 4 is a section according to the line IV—IV of FIG. 3.

The exemplary embodiment illustrated in FIGS. 3 and 4 differs from the above-described exemplary embodiment only in that after the removal of the spacing strips, the intermediate spaces 4 and the free spaces 9 have been filled with the compression molding material 10 used for the known compression molded collector. Such compression molding material 10 may be an insulating material or an extruded mass.

Figure 5:
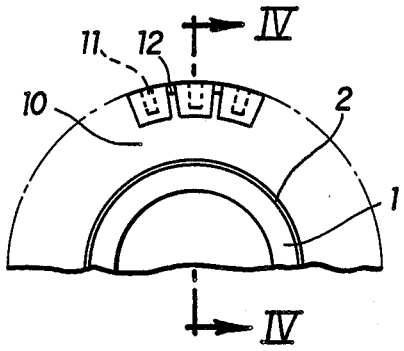
FIG. 5 is a view according to FIG. 1 of a third exemplary embodiment.
Figure 6:
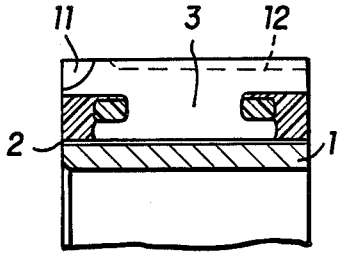
FIG. 6 is a section according to the line VI—VI of FIG. 5.

In the exemplary embodiment illustrated in FIGS. 5 and 6, as in the exemplary embodiment illustrated in FIGS. 3 and 4, compression molding material is introduced into the intermediate spaces 4 and the free spaces 9. While the free spaces 9 are completely filled, as shown in FIG. 6, the compression molding material 10 in the intermediate spaces 4 in the dimension serving as the brush contact surface ends at a distance from the outer cover surface of the commutator. The openings thus formed between adjacent segments 3 are designated with the numeral 12.

The manufacture of the exemplary embodiment according to FIGS. 5 and 6 differs from the manufacture of the second exemplary embodiment only in that with the aid of elements engaging between the segments 3, the openings 12 are prevented from being filled with compression molding material.

Figure 7:
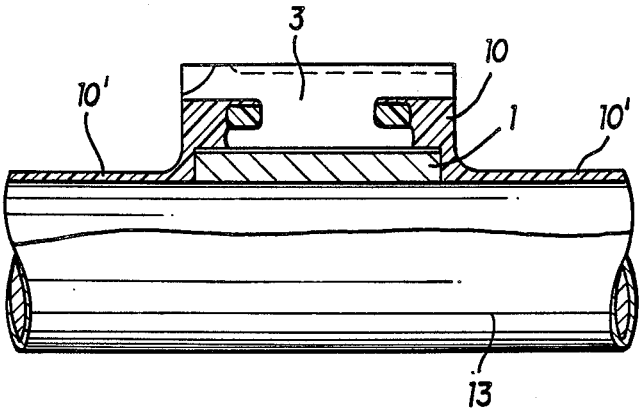
FIG. 7 is a longitudinal section through a fourth exemplary embodiment.

As shown in FIG. 7, the compression molding material can also cover the two frontal surfaces of the hub 1 which supports the segments 3 and is provided with insulation on its outer cover surface, and can extend to the ends of the shaft 13 supporting the commutator while forming a covering 10' therefor. The commutator formed like the exemplary embodiment according to FIGS. 5 and 6 is therefore fixed in place before the compression molded material 10 is introduced onto the shaft 13.

Figure 8:
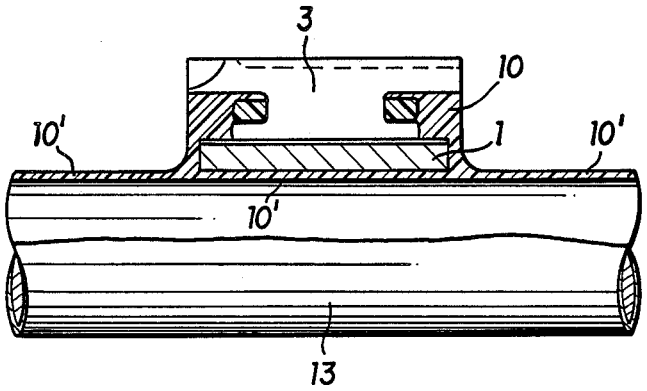
FIG. 8 is a longitudinal section through a fifth exemplary embodiment.

As shown in FIG. 8, the inside diameter of the hub 1 can also be selected to be greater than the outside diameter of the shaft 13. If, in this case, the hub 1 of a commutator constructed according to the above-described exemplary embodiments is arranged concentric to the shaft 13 and the compression molding material 10 is then introduced, the covering 10' of the shaft 13 can extend into the annular opening between the hub 1 and the shaft 13 without interruption and the commutator can be rigidly connected with the shaft 13 by means of this covering 10'.

It is noted that, while a hub 1 forms the support for segments 3 in the embodiments illustrated in FIGS. 1–6 and that a hub 1 and shaft 13 are illustrated in the embodiments of FIGS. 7 and 8, any combination of hub and/or shaft may form the support for the segments in the illustrated embodiments and appended claims, except where expressly precluded by the illustrated structure of claim language.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A commutator for small to medium-sized machines comprising:

an insulated rigid hub defining a longitudinal axis of the commutator;

a plurality of circumferentially spaced segments having boundary surfaces defining an inner cover surface facing the longitudinal axis of the commutator, said inner cover surface directly abutting said insulated rigid hub, said plurality of circumferentially spaced segments forming a body;

at least one annular groove formed in said body, said annular groove lying concentric to said inner cover surface;

a biased reinforcing ring arranged in said at least one annular groove so as to apply a radial compression load between said body and said hub;

wherein the body formed by the segments, at least in the dynamically and thermally unloaded condition of the commutator, is free of arch compression, and the segments, under said compression load from said insulated hub, are acted upon in a radial direction with a compression which corresponds to the entire biasing of all present reinforcing rings.

2. A commutator according to claim 1, wherein the compression loading effected on the basis of all present reinforcing rings on the hub through the segments is greater than the reduction therein that occurs during operation of said commutator.

3. A commutator according to claim 1, wherein each segment has a material portion formed between the annular groove and the boundary surface defining the inner cover surface, and each material portion has a height measured radially such that its stiffness in resistance to a permanently deforming bending is less than the bending load exerted by the reinforcing ring.

4. A commutator according to claim 1, wherein an intermediate space is provided between each segment, and said intermediate spaces are at least partially filled with an insulating material.

5. A commutator according to claim 4, wherein the insulating material of the inermediate spaces ends at a distance from a brush contact surface of said commutator.

6. A commutator according to claim 1, wherein a free space is provided in each of said segments between said groove and a front surface of said segments, and said free space is at least partially filled with an insulating material.

7. A commutator according to claim 1, in which said hub is arranged on a shaft, and an insulating material is provided on said shaft extending uninterruptedly from the two frontal sides of the body formed by the segments axially toward the shaft ends and forms a covering for the shaft.

8. A commutator according to claim 7, wherein the inside diameter of the hub is larger than the outside diameter of the shaft and the hub is held fixed in position concentrically to said shaft by means of an insulated material covering of the shaft which extends uninterruptedly from the frontal sides of the segments axially into the space between the hub and the shaft and to the ends of the shaft.

9. A commutator according to claim 1, wherein the insulation between the hub and the segments is formed by a pressure and heat resistant foil which is wrapped circumferentially around the hub and at least forms simple overlaps.

10. A commutator according to claim 9, wherein said insulation comprises a self-adhesive foil.

11. A commutator according to claim 9, wherein said insulation comprises a foil that is bakable in the overlapping areas.

12. A commutator according to claim 1, wherein said insulation comprises a thin-walled pressure and heat resistant insulating tube that is shrink-fitted onto the outer cover surface of the hub.

13. A commutator according to claim 1, wherein said insulation comprises a tube made from a pressure and heat resistant insulating foil that is shrink-fitted onto the outer cover surface of the hub.

* * * * *